US007238243B2

(12) United States Patent
Brantley et al.

(10) Patent No.: US 7,238,243 B2
(45) Date of Patent: Jul. 3, 2007

(54) MOTORIZED TOWABLE SWEEPING APPARATUS AND RELATED METHOD

(75) Inventors: Daniel J. Brantley, Dallas, TX (US); Daniel Lavely, Copper Canyon, TX (US); David W. Franklin, deceased, late of Dallas, TX (US); by Chrystine Franklin, legal representative, Dallas, TX (US)

(73) Assignee: Mister Sweeper, LP, Dallas, TX (US)

( * ) Notice: Subject to any disclaimer, the term of this patent is extended or adjusted under 35 U.S.C. 154(b) by 0 days.

(21) Appl. No.: 11/257,357

(22) Filed: Oct. 24, 2005

(65) Prior Publication Data

US 2006/0085945 A1 Apr. 27, 2006

Related U.S. Application Data

(60) Provisional application No. 60/621,792, filed on Oct. 25, 2004.

(51) Int. Cl.
*E01H 1/08* (2006.01)

(52) U.S. Cl. ..... 134/21; 15/340.1

(58) Field of Classification Search ..... 15/79.2, 15/82, 83, 340.1, 340.2, 340.3, 340.4, 347; 134/21

See application file for complete search history.

(56) References Cited

U.S. PATENT DOCUMENTS 35,365 A 5/1862 Daboll
1,042,860 A * 10/1912 Whittome ..... 15/83
1,399,634 A * 12/1921 Lund ..... 15/183
3,201,819 A * 8/1965 Wilgus ..... 15/349
3,354,489 A 11/1967 Ehrlich
4,001,908 A * 1/1977 Franklin ..... 15/83
4,221,018 A * 9/1980 Hajdu ..... 15/347
5,218,732 A * 6/1993 Pettigrew et al. ..... 15/4
5,416,949 A * 5/1995 Jute ..... 15/339

FOREIGN PATENT DOCUMENTS

JP 11-264124 * 9/1999

OTHER PUBLICATIONS

Tow-Vac Informational Brochure, Jun. 2003, 4 pages.
"Tow-Vac Video Tour 2004" from Tow-Vac Promotional CD, "TowVAC AVI 02-11-03.mpg" (with printed transcription), Feb. 2003.

* cited by examiner

*Primary Examiner*—Terrence R. Till
(74) *Attorney, Agent, or Firm*—Winstead PC

(57) ABSTRACT

A towable sweeping apparatus includes a housing supported by a plurality of surface-engaging wheels and an impeller mounted to the housing and adjustable relative to the surface. The impeller includes a plurality of blades rotatable about an axis. A space permitting air flow is present between a portion closest to the axis of at least one of the plurality of blades and the axis. The towable sweeping apparatus also includes a drive motor inter-operably connected to the impeller and a bin arranged to receive debris collected by the impeller. The bin includes an angulated surface adapted to facilitate removal of debris from the towable sweeping apparatus.

17 Claims, 8 Drawing Sheets

504a
504b
504c
504d
504e
504f
504g
504h
502
506
508
510
13

502
504c
504g
516
512
514
13

MOTORIZED TOWABLE SWEEPING APPARATUS AND RELATED METHOD

CROSS-REFERENCE TO RELATED APPLICATIONS

This patent application claims priority from, and incorporates by reference the entire disclosure of, U.S. Provisional Patent Application No. 60/621,792, filed Oct. 25, 2004.

BACKGROUND

1. Field of the Invention

The present invention relates to a sweeping apparatus, and more particularly, but not by way of limitation, to a motorized, towable sweeping apparatus for collecting dirt and debris over a surface to be swept.

2. History of Related Art

Advancements in the art of street sweeping apparatus are characterized and embodied in patents spanning more than a century. Original mechanized models were non-motorized versions, necessitated by the early state of the art. Incumbent upon the inventors of the 1800's was a street sweeping machine utilizing "horse power" in its strictest sense. Such machines utilized rotation of ground-surface-engaging wheels to drive sweeping brushes in a sweeping operation. Such a sweeper is disclosed in U.S. Pat. No. 35,365, issued to Daboll in 1862, wherein a cylindrically-shaped brush was operated through engagement of rigid frictional drive rollers for collection of dirt and debris in bin storage areas formed within a sweeping-unit housing.

Advancements in the sweeping art were consistent with those of a mechanized society. Chain drives, gears, and pawl-and-ratchet combinations were introduced in an effort to achieve a sweeping unit design which could be built, maintained, and operated economically with great effectiveness. With the advent of the internal combustion engine, such units became self-powered and therefore relatively complex and costly. But as complexity increased, so did problems in operation and maintenance. Debris and unwanted materials, although the collection of which was typically an object of the sweeping operations, often formed abrasives that interfered with a myriad of moving parts in the self-powered sweeping units.

The self-powered sweeping units proved to be most effective in large-scale sweeping operations. However, due to the overall size of such units, they were often impractical for smaller industrial uses in which several cleaning locations were spread apart. Physically and economically it proved to be impractical to transport large, self-powered sweepers for relatively small cleaning jobs.

As more recent patents illustrate, sweeper attachments have therefore been provided for lift trucks and similar motorized vehicles particularly adapted for pushing or pulling of the sweeper attachment over a surface to be swept. Such vehicles are often located at industrial sites for other unrelated uses.

Some of the advancements in attachable sweepers utilized the developments of the early art in direct wheel-to-brush-drive rotational interengagement. For example, U.S. Pat. No. 3,354,489, issued to S. V. Ehrlich on Nov. 28, 1967, discloses a sweeper attachment for a lift truck. This and other similar sweeping machines incorporate drive-wheel transmissions, one-way over-riding clutches, enclosed bin areas adjacent the brush, and means for engaging the unit for lifting it to deposit debris within. These units further include features such as floating steering and a method of attachment utilizing adaptation of all makes and models of lift trucks.

Another advancement in the area of attachable sweepers is that shown in U.S. Pat. No. 4,001,908, in which David W. Franklin is the inventor. In this 1977 patent, there is set forth and shown a sweeping apparatus for coupling to a motorized vehicle with design aspects adapted for increasing the efficiency of the sweeping operation as the sweeper passes over a surface to be swept. As shown therein, a sweeping brush is rotatably driven by a surface engaging wheel through one or more expandable drive capstans coaxially affixed to the sweeping brush. In recent years, the aspect of a towable sweeper with an independent, motorized sweeping brush has been developed and utilized. Today, towable sweeping units with motorized sweeping brushes permit enhanced sweeping of surface areas containing dirt and debris utilizing conventional vehicles such as pickup trucks and the like. Other improvements in the design and efficiency of such motorized, towable sweepers would, of course, be beneficial to sweeping operations.

SUMMARY OF THE INVENTION

A towable sweeping apparatus includes a housing supported by a plurality of surface-engaging wheels and an impeller mounted to the housing and adjustable relative to the surface. The impeller includes a plurality of blades rotatable about an axis. A space permitting air flow is present between a portion closest to the axis of at least one of the plurality of blades and the axis. The towable sweeping apparatus also includes a drive motor inter-operably connected to the impeller and a bin arranged to receive debris collected by the impeller. The bin includes an angulated surface adapted to facilitate removal of debris from the towable sweeping apparatus.

A method of sweeping debris from a surface, the method includes providing a sweeping apparatus that includes an impeller the impeller comprising a plurality of blades rotatable about an axis, a plurality of surface-engaging wheels, a motor inter-operably connected to the impeller; and a bin arranged to receive debris collected by the impeller. The bin includes an angulated surface adapted to facilitate removal of debris from the sweeping apparatus. The method also includes the motor driving the impeller at a rotational speed of not greater than 700 revolutions per minute in a direction opposite a rotational direction of the plurality of surface-engaging wheels, depositing debris swept from the surface by the impeller into the bin, and the debris tending to move down the angulated surface toward an end of the sweeping apparatus opposite a direction of travel of the sweeping apparatus.

DETAILED DESCRIPTION OF THE INVENTION

The present invention relates to a motorized, towable sweeping apparatus. More particularly, one aspect of the present invention relates to a motorized towable sweeping apparatus particularly adapted for efficiently collecting dirt and debris in an area over which the apparatus is towed and efficiently discharging that which has been collected. Various embodiments of the sweeping apparatus include a drive unit for driving a rotatable impeller, which may be adjusted relative to the surface over which it is rotated. A debris collection bin adjacent thereto and in flow communication therewith is angulated to facilitate the discharge of debris from the debris collection bin after sweeping. In another aspect, side members adjacent to the rotatable impeller are selectively vented or opened for imparting a selective air flow to increase the suction on one side of the sweeping apparatus for use around curbs and the like.

In yet another aspect, various embodiments of the present invention include debris extension fenders disposed forwardly of the sweeping apparatus for aligning collected debris prior to passage beneath the sweeping apparatus. The fenders may extend a select distance alongside the sweeping apparatus for directing air flow and maintaining sweeping integrity.

In a further aspect, various embodiments include a side-mounted blower system with a spring-loaded nozzle adapted for directionally discharging air into an area alongside the motorized towable sweeping apparatus to facilitate collection of dirt and debris. The spring-loaded nozzle includes a flexible conduit and mounting system that is adapted to accommodate angulation and movement of the type imparted when encountering an object such as a telephone pole or the like during the sweeping operation without damaging the blower system. In this manner, an air discharge stream is reliably positioned in association with the sweeping apparatus to further enhance a sweeping operation.

Figure 1:
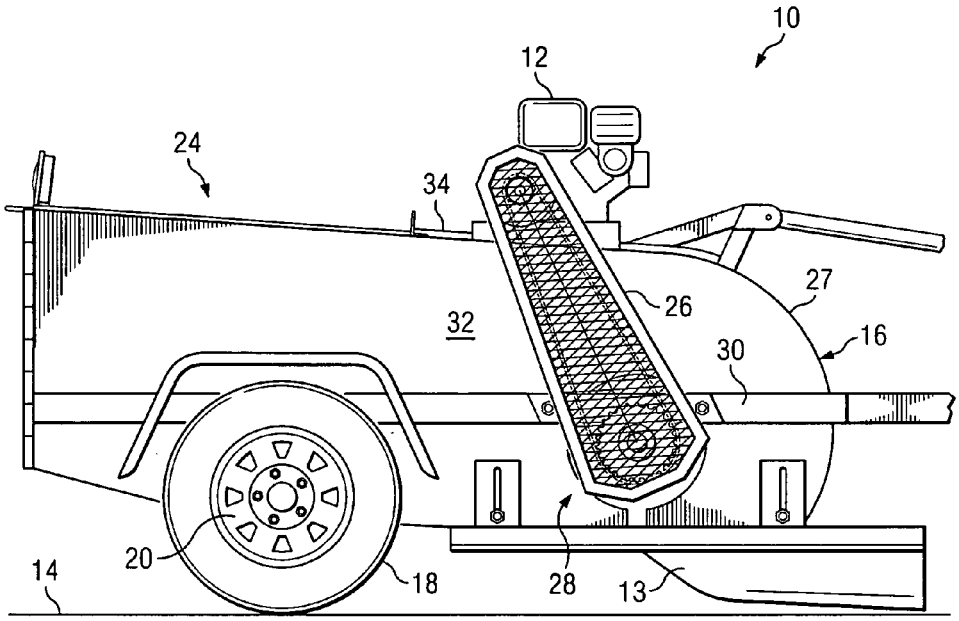
FIG. 1 is a side perspective view of a towable motorized sweeping apparatus in accordance with the principles of the present invention.

Referring first to FIG. 1, there is shown a towable motorized sweeping apparatus 10 adapted to be coupled to a vehicle such as, for example, a pickup truck (not shown). The sweeping apparatus 10 includes a motor 12 for driving an impeller 13 (which may include a series of paddles, rubber flaps, or the like as described further below) while being towed behind the vehicle over a surface 14. The surface 14 may include streets, parking lots, alleys, and the like. The sweeping apparatus 10 also includes a housing 16 pivotally supported about and by a pair of surface-engaging wheels 18 rotatably mounted on opposite sides of the housing 16 across an axle 20. The generally cylindrically-shaped impeller 13 is rotatably mounted in a fore part of the housing 16 in a horizontal transversely-extended relationship adjacent to and in generally parallel-spaced relationship with the axle 20 (not shown in this view). The impeller 13 is adapted to rotate close to, or in contact with, the surface 14.

Still referring to FIG. 1, rotation of the impeller 13 is driven by the motor 12, which includes a chain drive 26 coupled to a drive sprocket 28 imparting rotation to the impeller 13. The use of a separate drive motor 12 is not, in and of itself, novel. The impeller 13 may be formed with blades, baffles, or brush bristles that are mounted to an elongate shaft for rotation therewith against or over the surface 14. Examples will be shown below. The rotation of the blades, baffles, and/or brushes will impart a flow of air, as well as optional physical engagement of the debris therebeneath, when the impeller 13 is so adjusted. In this manner, the debris is forced upwardly into a bin area 24 of the sweeping apparatus 10 as will be described in more detail below.

Still referring to FIG. 1, the housing 16 is formed of lightweight metal walls and constructed along a suitably strong frame 30. The walls include a curved front wall 27, opposite side walls 32, and a top wall 34. The walls 27, 32, and 34 are constructed for protecting moving parts within and to form the bin area 24 in a refuse-receiving configuration. As will be described below, the bin area 24 includes a perforated top and an angulated floor facilitating both air flow and allowing for ease in discharge of debris collected therein.

Figure 2:
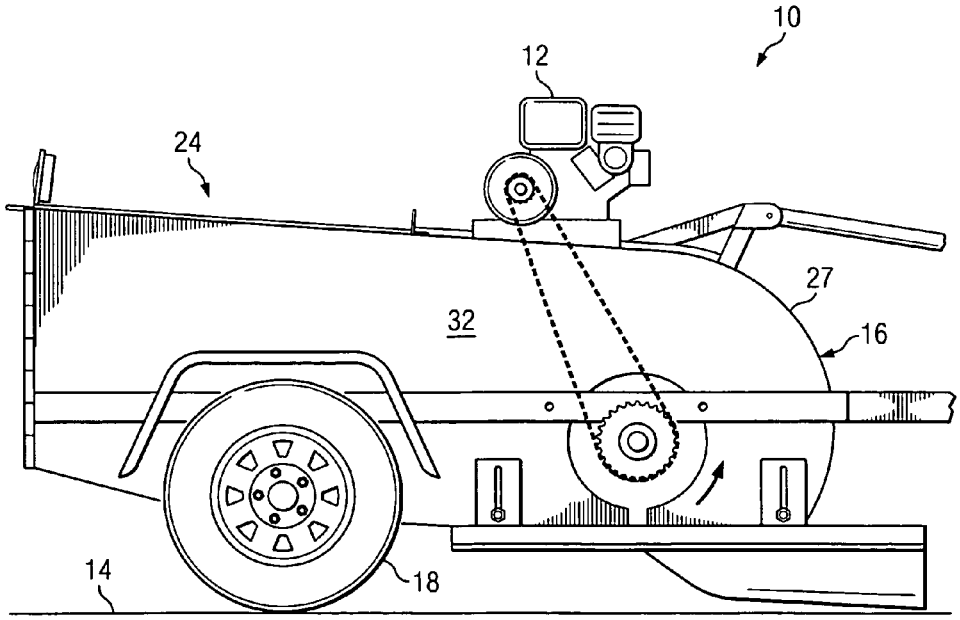
FIG. 2 is a side perspective view of a towable motorized sweeping apparatus in accordance with the principles of the present invention.

Referring now to FIG. 2, the operation of the motor 12 of another embodiment of the sweeping apparatus 10 produces a rotation of the impeller 13, in the direction of the arrow shown, for moving debris upwardly and into the bin area 24. It may be seen that the wall 27 of the housing 16 is curved at a radius greater than that of the impeller 13 to serve as a guiding surface for the rotation of the impeller 13. Various embodiments of the invention serve to impart increased efficiency to the sweeping operation, as well as the emptying of the debris therefrom for improving the operational efficiencies associated with the sweeping operation.

Still referring to FIG. 2, the embodiment of the sweeping apparatus 10 shown herein includes relatively small changes relative to FIG. 1, and thus the sweeping apparatus 10 retains its original numerical designation. For example, the sweeping apparatus 10 of FIG. 2 does not illustrate a cable winch as is shown in FIG. 1, and placement of various adjustments and associated aspects of the invention, currently in a development phase, appear. For purposes of this application, the sweeping apparatus 10 of FIGS. 1 and 2, although slightly different one from the other, will be collectively referred to as the sweeping apparatus 10, and the version of the sweeping apparatus 10 appearing in FIG. 2 will likewise be addressed in the description of the following illustrations.

Figure 3:
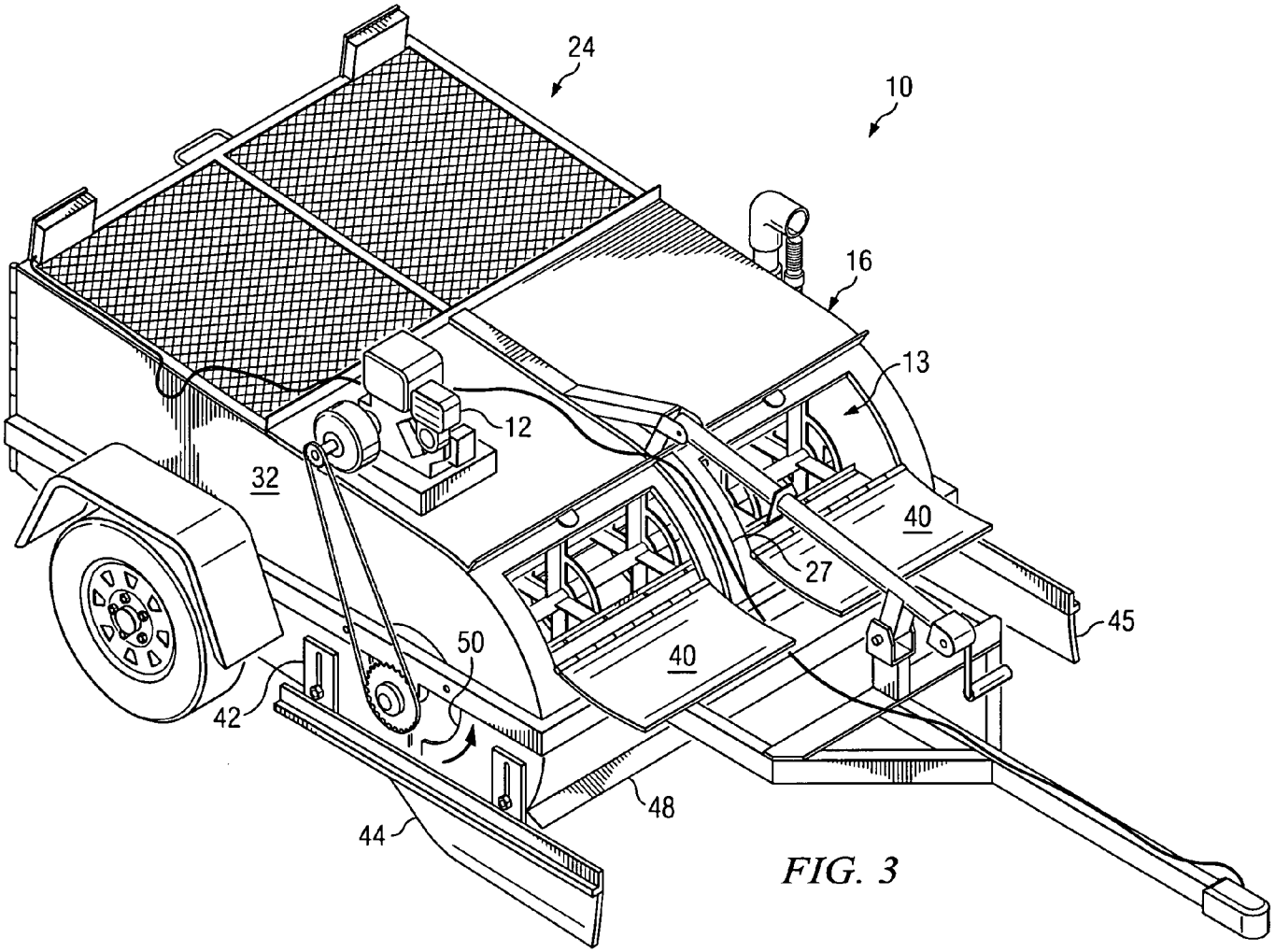
FIG. 3 is a perspective view of the towable motorized sweeping apparatus of FIG. 1.

Referring now to FIG. 3, there is shown a front perspective view of the sweeping apparatus 10 with additional illustration of various aspects thereof. It may be seen that the wall 27 of the housing 16 is not only curved at a radius greater than that of the impeller 13 to serve as a guiding surface for the rotation of the impeller 13, but also includes in this particular embodiment, a pair of doors 40 providing access to the impeller 13. In this particular embodiment, the impeller 13 is comprised of a plurality of rubber blades that extend radially outwardly from a shaft 42 for generating the sweeping motion described herein and driven by the motor 12 referred to above. The impeller 13, as well as debris to be removed located thereon, is thus accessible through the doors 40.

Still referring to FIG. 3, a pair of side sweeping skirts 44 and 45 is shown, which sweeping skirts 44 and 45 extend forwardly of the housing 16 of the sweeping apparatus 10 in order to facilitate collection of debris passing under a flexible frontal skirt 48 disposed along the front of the housing 16. Due to the rotation of the impeller 13 upwardly in the direction of the arrow shown, the skirt 48 inhibits debris from being swept back out from underneath the housing 16. Moreover, the skirts 44, 45 and 48 further enhance and control a flow of air that is sucked into the impeller 13 by virtue of the rotation thereof. In that regard, a venting aperture 50 is shown on the side wall 32 of the housing 16, wherein the impeller 13 may be seen therein. Rotation of the impeller 13 draws air through the generally circular vent 50 causing an air flow in the direction from the vent 50 into the area of the impeller 13 and upwardly into the area of the bin 24, as will be described in more detail below. It will also be seen in subsequent FIGURES that an area of the vent 50 on the opposite side of the housing 16 may be selectively blocked to prevent or reduce the inflow of air in that particular area for purposes of controlling the collective air flow and creating a preferential drawing of air from beneath the impeller 13 on the side of the housing 16 opposite the motor 12. As will be described below, this drawing of air from beneath the unit is helpful in the sweeping of areas of curbs and the like for which the area of the housing 16 opposite the motor 12 will be disposed adjacent the curb in conjunction with a separate blower, described below, for facilitating the sweeping operation.

Figure 4:
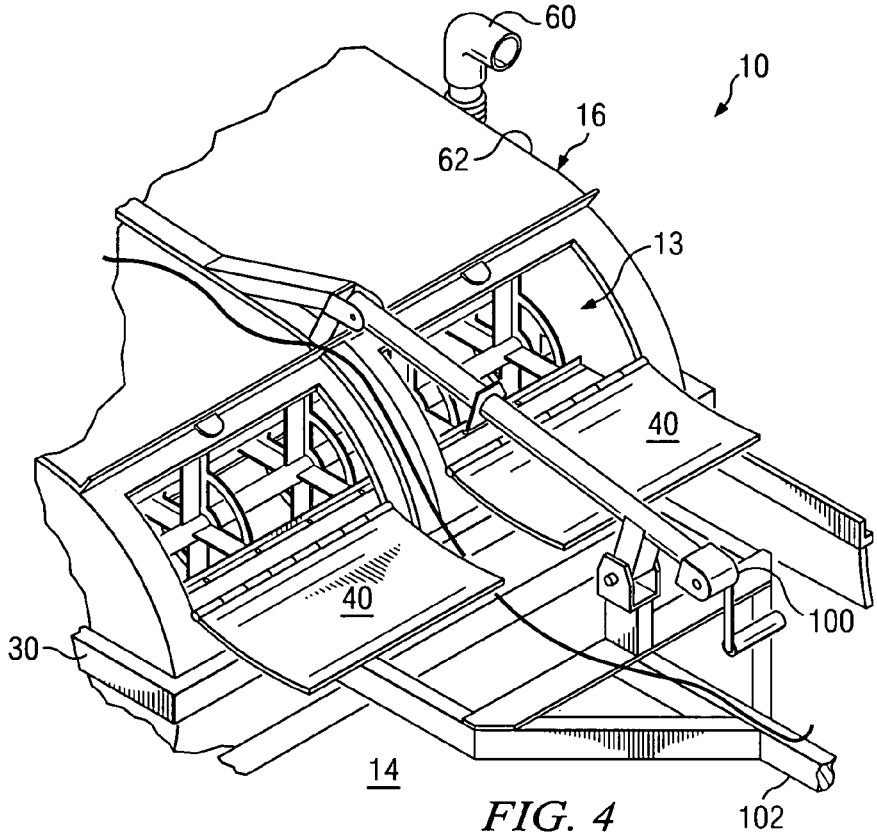
FIG. 4 is an enlarged perspective view of the towable motorized sweeping apparatus of FIG. 1.

Referring now to FIG. 4, the sweeping apparatus 10 is shown in an enlarged perspective view similar to FIG. 3 wherein debris on the impeller 13 can be more clearly seen through the open doors 40 of the housing 16. As is also shown in this particular FIGURE, a nozzle 60 is shown upstanding from side 62 of the housing 16 to facilitate a blowing operation as is necessary, for example, when the sweeping apparatus 10 is pulled alongside a curb, as will be described in more detail below. The nozzle 60 is secured against the side 62 in this view and FIG. 8, as compared to FIG. 9, where the nozzle 60 is fully deployed.

Figure 5A:
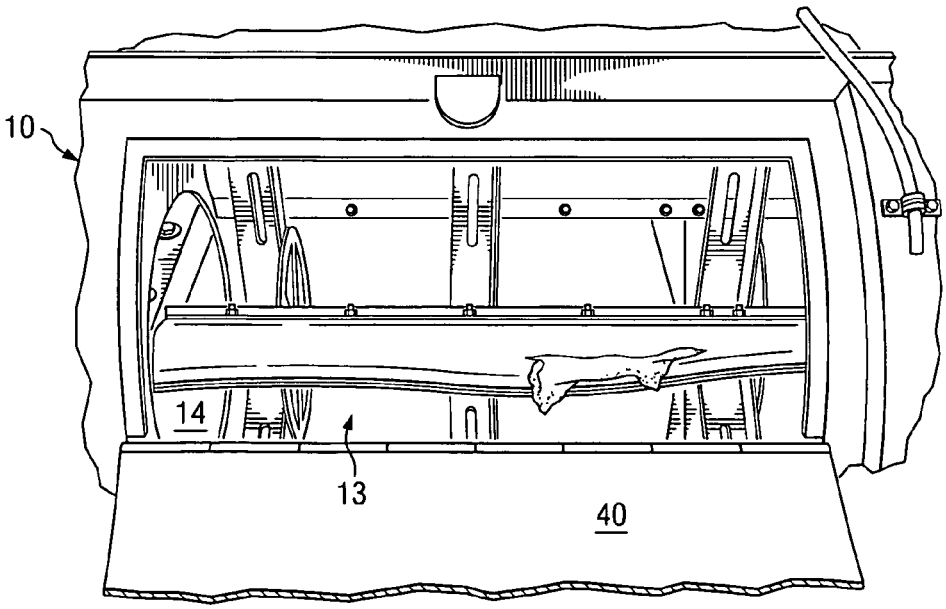
FIG. 5A is a front perspective view of an impeller and housing in accordance with principles of the invention.

Referring now to FIG. 5A, there is shown a large front elevational view of the impeller 13 of the sweeping apparatus 10, wherein the impeller 13 having impeller blades 502 thereof containing debris thereon are more clearly shown. Access through the door 40 provides the ability of an operator to remove debris and/or to determine if adjustments relative to the impeller 13 adjacent the surface 14 are required.

Figures 5B, 5C:
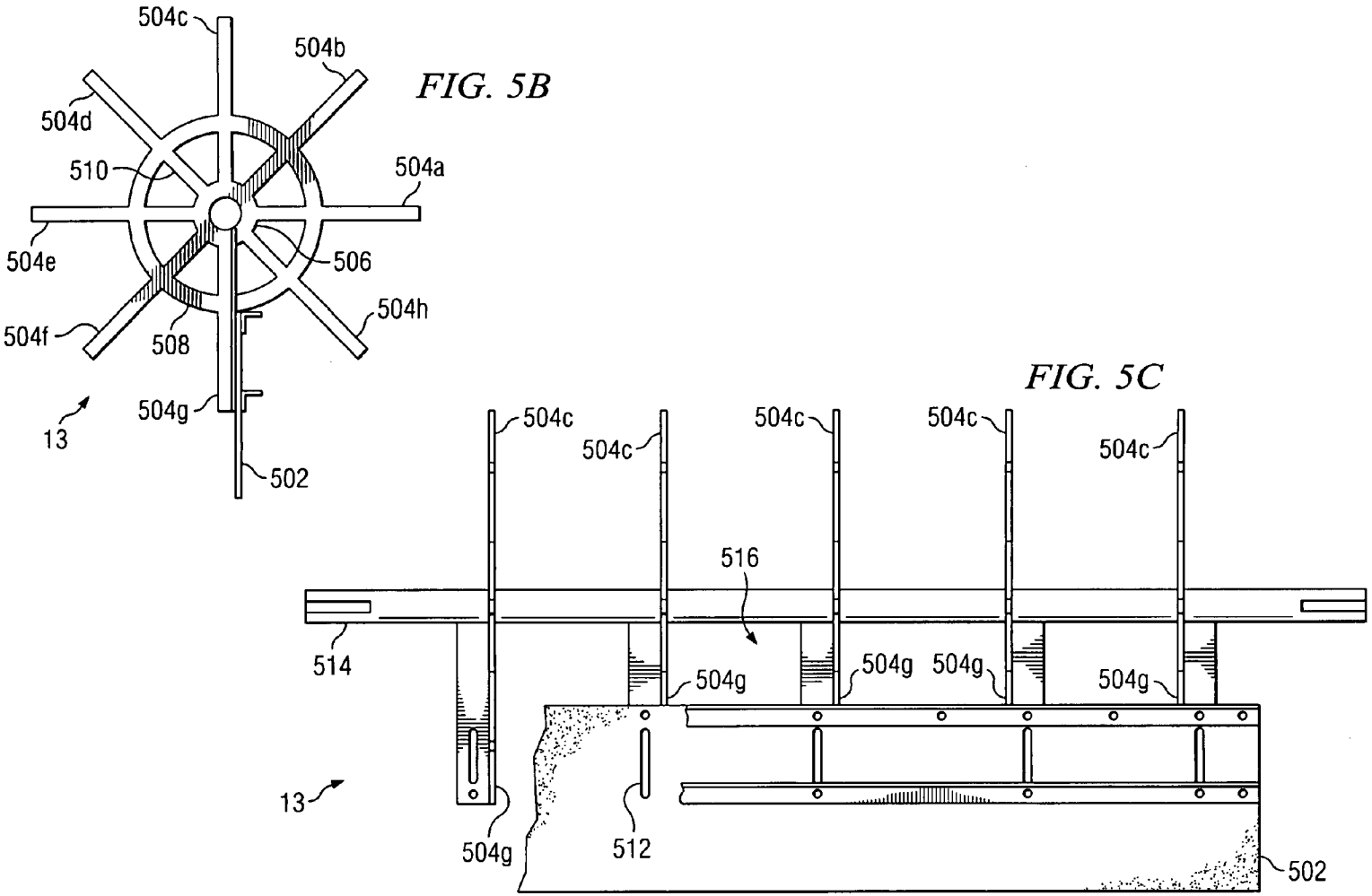
FIG. 5B is a side elevational view of an impeller in accordance with principles of the present invention.
FIG. 5C is a front elevational view of the impeller illustrated in FIG. 5B.

Referring now to FIG. 5B, a side elevational view of an embodiment of the impeller 13 is shown. The impeller 13 illustrated in FIG. 5B is shown with a single impeller blade 502; however, it will be understood by those having skill in the art that in typical applications all of impeller arms 504(*a*)–(*h*), rather than only the impeller arm 504(*g*) as shown, will have attached thereto an impeller blade 502. The impeller 13 also includes an inner ring 506 and an outer ring 508, which rings 506 and 508 are interconnected by a plurality of axial members 510, only one such axial member 510 being explicitly labeled. Each of the axial members 510 is shown in alignment with two corresponding impeller arms 504, although this need not necessarily be the case to remain in accordance with principles of the invention. The inner ring 506 forms an aperture for insertion of the shaft 42 for support and rotation of the remainder of the impeller 13. The arrangement of the inner ring 506, the outer ring 508, and the axial member 510 permit air flow from outside the sweeping apparatus 10 via the side vents 50 into the impeller 13 to readily occur.

Although eight impeller arms 504 and corresponding axial members 510 are shown in FIG. 5B, it will be understood by those having skill in the art that the impeller arms 504 and the axial members 510 need not necessarily be aligned as shown in FIG. 5B. Moreover, the number of impeller arms 504, impeller blades 502, and axial members 510 may be selected according to design considerations without departing from principles of the invention. In addition, the axial members 510 may be shaped differently than shown in FIG. 5B without departing from principles of the invention, so long as the impeller 13 receives sufficient air flow for operation and sufficient structural integrity is maintained between the inner ring 506 and the outer ring 508. Moreover, the number of axial members 510 needed to support a given impeller arm 504 (e.g., 8 in FIG. 5C) will be appreciated by those having skill in the art to be one that can be varied according to design constraints without departing from principles of the present invention.

FIG. 5C is a front elevational view of the impeller 13 including the impeller blade 502. The impeller blade 502 is illustrated as attached to the impeller arm 504(*g*) via a series of fasteners, such as, bolts, screws or the like. However, it will be understood that the mode of attachment of the impeller blade 502 can be varied without departing from principles of the invention.

The impeller blade 502 has formed therein a series of slots 512 adapted to permit the impeller blade 502 to be slideably and adjustably engaged with a plurality of impeller arms 504. Such slideable and adjustable engagement permits the impeller blades 502 to be adjusted as needed such as, for example, when the impeller blades 502 wear down in use or in order to achieve greater or lesser open space between a central axis 514 of the impeller 13 and the impeller blades 502, an example of the space being indicated by reference numeral 516, Thus, in addition to the apertures formed by the inner ring 506, the outer ring 508, and the axial members 510, slideable engagement of the impeller blades 502 with the impeller arms 504(*g*) permits additional air flow between horizontal sections of the impeller blade 502 demarcated by successive impeller arms 504 and thus facilitates effective sweeping by the sweeping apparatus 10.

Figure 5D:
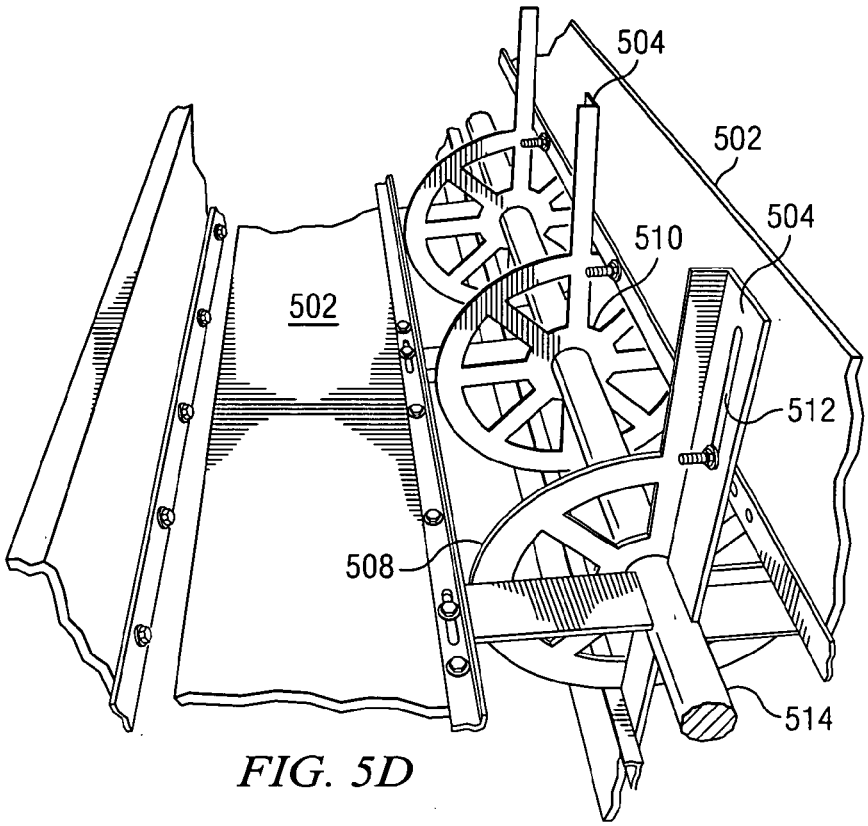
FIG. 5D is a side perspective view illustrating the impeller and housing in accordance with the principles of the invention.

Testing has indicated that a relatively-slow minimal impeller rotational speed of operation is needed in order to achieve desired results. For example, a rotational speed of 500–700 RPM has been found to reduce cavitation when the sweeping apparatus 10 is picking up light debris while functioning as an air sweeper (i.e., when the impeller blades 502 do not actually touch the debris) and also when the sweeping apparatus 10 is operating as a contact sweeper (i.e., when the impeller blades 502 actually contact the debris). Relatively-slow rotational speed of the impeller 13 has numerous benefits, including, but not limited to, reduced fuel costs, reduced wear on the impeller blades 502 and other components of the sweeping apparatus 10, and reduced environmental noise. FIG. 5D is a side perspective view illustrating an impeller 13 with four impeller blades 502 attached thereto.

Figure 6A:
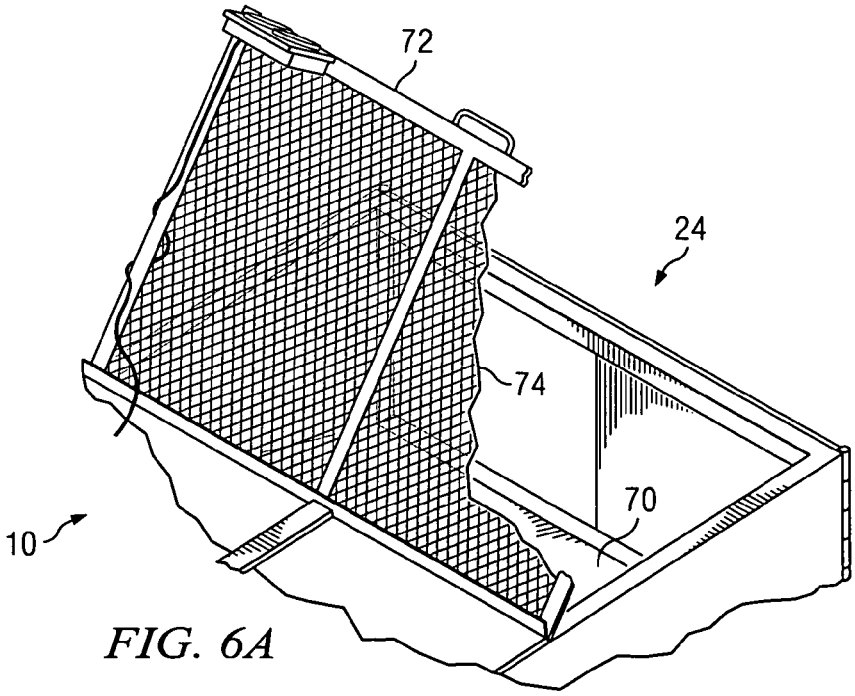
FIG. 6A is a rear perspective view of the impeller illustrated in FIG. 5A.

Referring now to FIG. 6A, there is shown a partial rear perspective view of the sweeping apparatus 10 wherein the bin area 24 is more clearly shown. The bin area 24 includes an angulated surface 70 and an upper lid 72 that is perforated for allowing the flow of air outwardly therefrom. The upper lid 72 is shown to be formed with a grate structure 74 allowing the flow of air therethrough while trapping debris therein. The angulated surface 70 is shown to be of a piece of sheet metal extending downwardly at an angle so that any debris captured therein may be easily removed by opening the rearward doors of the bin area 24, as described in more detail below.

Figure 6B:
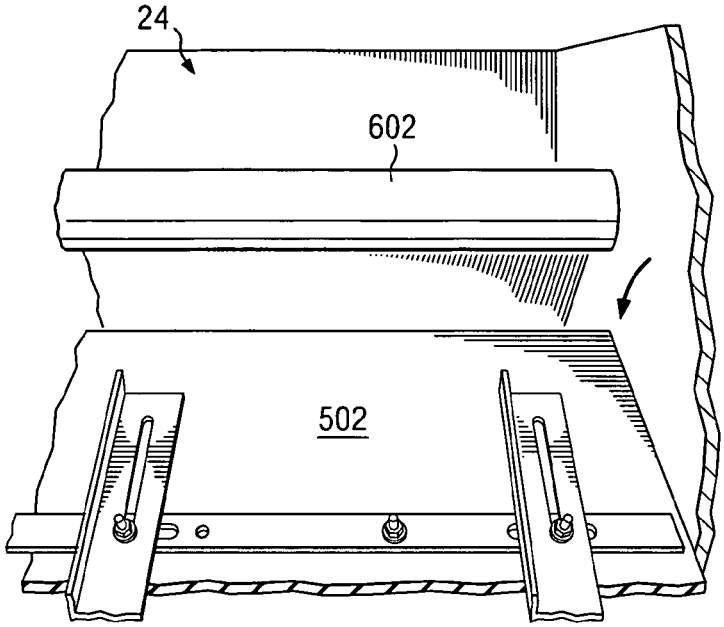
FIG. 6B is a front perspective view of a semi-cylindrical scraping member and an impeller blade in accordance with principles of the invention.

FIG. 6B is a close-up view of a transition area between an interior portion of the housing 16, in which the impeller 13 is located, and the bin area 24. A partial view of one of the impeller blades 502 is shown, the impeller blade 502 in operation having just passed by a semi-cylindrical scraping member 602 in a downward direction as indicated by the arrow in FIG. 6B. The semi-cylindrical scraping member 602 is adapted to provide a relatively-large surface area for interaction with the impeller blades 502 as they pass the semi-cylindrical scraping member 602 during operation. As there is no sharp surface against which debris caught by the impeller blades 502 can readily catch, such debris tends instead to be deposited into the bin area 24. As will be illustrated in further detail hereinbelow, the semi-cylindrical scraping member 602 may be adjusted relative to the rotating impeller blades 502 so that debris is readily deposited into the bin area 24. Developmental tests have indicated that desirable performance is achieved when the distance between a closest edge of the impeller blades 502 and a closest edge of the semi-cylindrical scraping member 602 is not greater than one inch as the impeller blades 502 rotate past the semi-cylindrical scraping member 602. Of course, as noted above, the distance between the semi-cylindrical scraping member 602 and the impeller blades 502 may also be varied by adjusting the impeller blades 502 relative to the impeller 13 via the slots 512.

Figure 7:
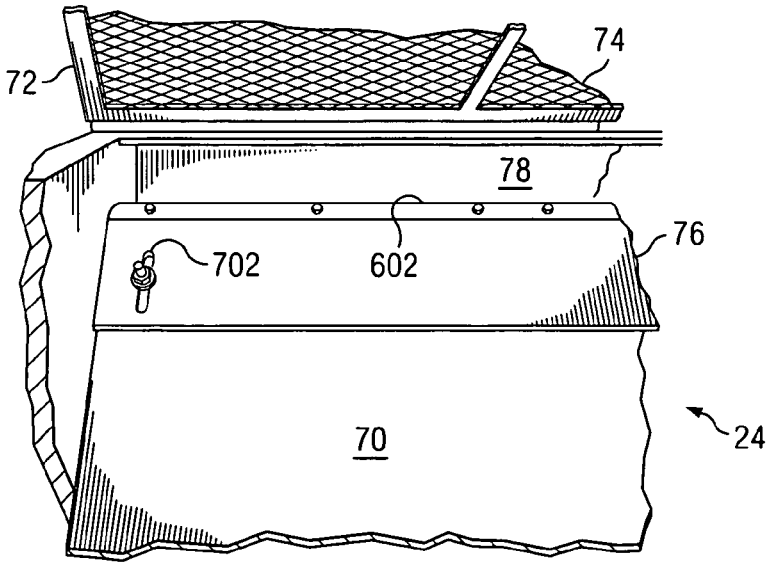
FIG. 7 is a rear perspective view of a bin area of a towable motorized sweeping apparatus in accordance with principles of the present invention.

Referring now to FIG. 7, there is shown the bin area 24 of FIG. 6, wherein the angulated surface 70 is more clearly shown beneath the grate 74 of upper lid 72. Also shown in FIG. 7 in more detail is an adjustable baffle 76 which is positioned along the opening 78 at the top of the angulated surface 70 and has attached thereto the semi-cylindrical scraping member 602. The opening 78, a small portion of which may be seen in this particular view, allows the flow of debris into the bin area 24. Adjustment of the baffle 76 serves to even out air flow in certain sweeping operations in addition to the purposes discussed above with respect to FIG. 6B is a slot 702 that permits adjustment of the baffle 76, and consequently the semi-cylindrical scraping member 602, relative to the rotating impeller blades 502. Although the semi-cylindrical scraping member 602 can, in some applications, result in performance improvements as indicated above, in some embodiments of the invention, it may be preferable to include only the baffle 76 and not the semi-cylindrical scraping member 602 as an interface with the rotating impeller blades 502, thus presenting a sharper transition area between the portion of the housing that contains the impeller 13 and the bin area 24.

Figure 8:
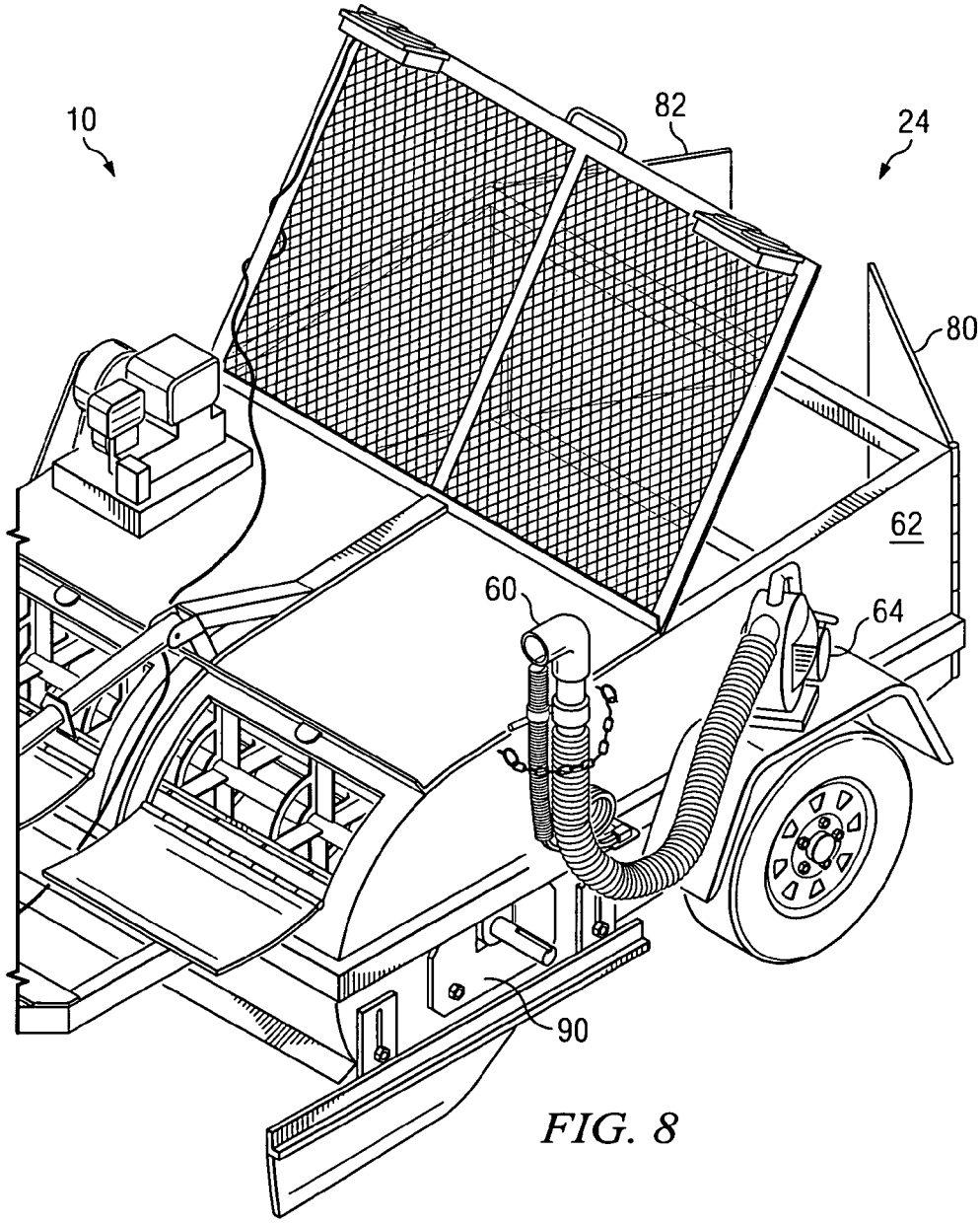
FIG. 8 is a side perspective view of the motorized sweeping apparatus illustrated in FIG. 1.
Figure 9:
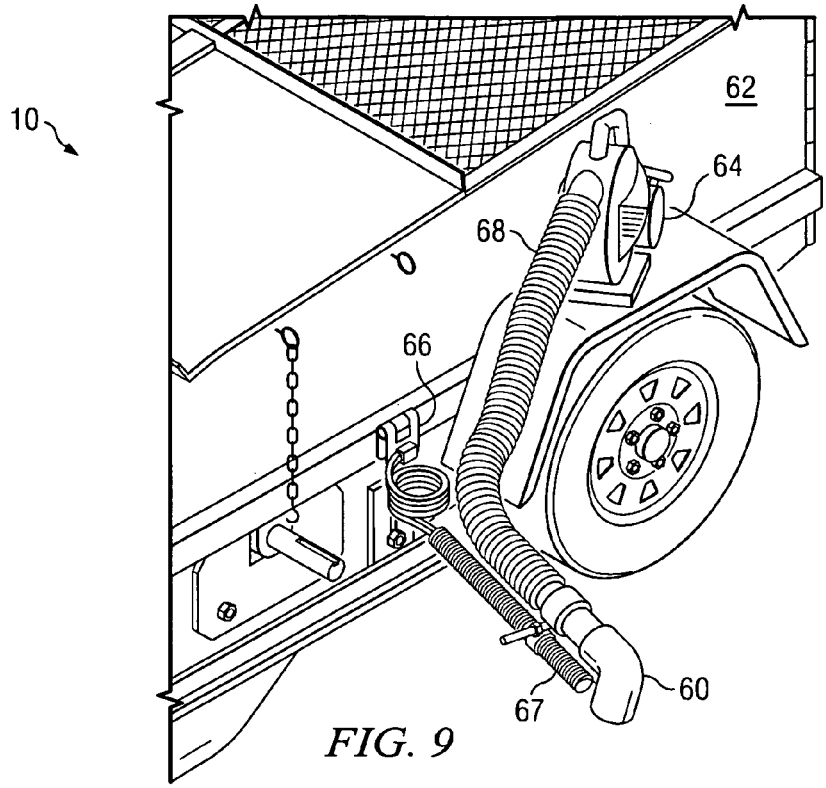
FIG. 9 illustrates a side blower attached to the towable motorized apparatus of FIG. 1.

Referring now to FIG. 8, there is shown a side perspective view of the sweeping apparatus 10, wherein the side 62 typically disposed adjacent curb regions is more clearly shown. The side area 62 is shown to be provided with an air blower 64 for discharging air through the nozzle 60. The nozzle 60 may be directed adjacent a curb as shown in FIG. 9. Still referring to FIG. 8, the sweeping apparatus 10 includes a pair of rear doors 80 and 82 adjacent the bin area 24 to facilitate the discharge of debris therefrom. Due to the angulated surface 70 described above, opening the doors 80 and 82 will allow the debris collected in the bin area 24 to easily be removed therefrom.

Referring now to FIG. 9, there is shown a perspective view of the side 62 of the sweeping apparatus 10. In this view, the blower 64 is shown in a fully-deployed position allowing the flow of air to be discharged from the nozzle 60 in a position outwardly from the sweeping apparatus 10 and angulated to throw debris forwardly out of the sweeper for collection therewith. The nozzle 60 is connected to the blower 64 through a flexible conduit 68. The position of the nozzle 60 is facilitated by a spring member 67 mounted to a pivot hinge structure 66 mounted to the side 62 of the sweeping apparatus 10. The spring member 67 and the pivot hinge structure 66 collectively allow both positioning of the nozzle 60 and movement of the nozzle 60 that may be necessary when the nozzle 60 engages an obstacle, such as a telephone pole or the like, while in operation. Due to the fact that the conduit 68 is flexible and that the spring member 67 is retractable, the nozzle 60 can be deflected around an object and will be brought back into position by the spring member 67 in a manner consistent with the operation of the sweeping apparatus 10 over different areas.

Figure 10:
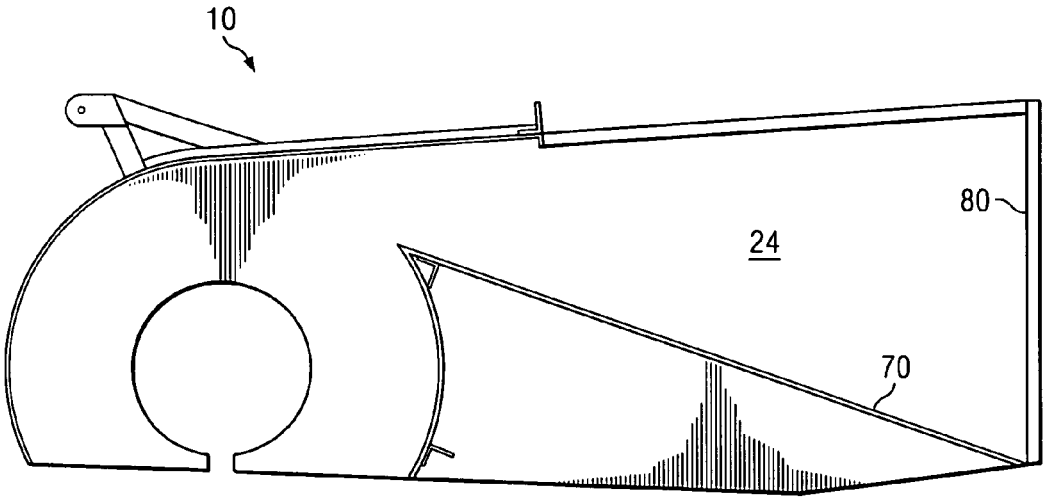
FIG. 10 is an enlarged side-elevational cross-sectional diagrammatic view in illustrating various aspects of construction of a towable, motorized sweeper in accordance with the principles of the invention.

Referring now to FIG. 10, there is a shown an enlarged side elevational cross-sectional diagrammatic view of the sweeping apparatus 10 illustrating various aspects thereof, such as the bin area 24 and the underlying, angulated surface 70 thereof. Collection of the debris in the bin area 24 is facilitated due to various design aspects described above, and the angulated surface 70 may be seen to impart ease in the discharge of collected debris when the doors 80 and 82 (FIG. 8) are opened. Of the bin area 24 facilitates insertion of one or more removable bins that may be slid or rolled into and out of the bin area 24 via, for example, the upper lid 72 or the doors 80–82. The removable bins may be made to be compatible with, for example, commercial automated garbage trucks.

In operation, the sweeping apparatus 10 affords multiple advantages over conventional towable sweeping units with motorized brush sweeping. Not only the side mounted blower nozzle 60 adapted for reliable directional assistance in the collection of debris in areas such as curbs and the like, but also, the skirts described above, help collect debris for subsequent passage under the impeller 13. The selective opening and/or covering of the vent areas on the sides of the housing 16 adjacent the impeller 13, as discussed above, further enhance the selective air flow as required in certain sweeping operations. For example, FIG. 8 illustrates the area of the impeller 13 baffled with a member 90 that inhibits the free flow of air from the side thereof. In this manner, more air flow is drawn from beneath the sweeping apparatus 10 as the sweeping apparatus 10 passes near a curb or the like. The member 90 may also be opened and/or partially closed. Various embodiments of the invention include means for adjusting the height of the impeller 13 relative to the surface 14 over which it passes. The impeller 13 may only pass over the surface 14, not touching it, in certain adjustments.

As shown in FIG. 4, an impeller adjustment mechanism 100 is illustrated whereby the position of the impeller 13 relative to the surface 14 over which the impeller 13 passes is adjusted. This adjustment is facilitated by pivotal angulation between adjustment members including a yoke 102 providing attachment to a vehicle and the frame 30 described above. Other adjustment mechanisms may, of course, be provided, but the impeller adjustment mechanism

100 shown in FIG. 4 has been demonstrated to be efficient in allowing for precise alignment of the impeller 13 relative to the surface 14 being swept. As recited above, the impeller 13 is adapted for both engaging the surface and/or for rotation slightly above the surface for the generation of air flow to gather the debris in accordance with enhanced air flow properties in accordance with principles of the present invention.

It is thus believed that the operation and construction of various embodiments of the present invention will be apparent from the foregoing description. While the method and apparatus shown or described has been characterized as being preferred, it will be obvious that various changes and modifications may be made therein without departing from the spirit and scope of the present invention.

In the foregoing Detailed Description, it can be seen that various features may be grouped together into a single embodiment for the purpose of streamlining the disclosure. This method of disclosure is not to be interpreted as reflecting an intention that the claimed embodiment(s) of the invention require more features than are expressly recited in each claim. Rather, as the following claims reflect, inventive subject matter lies in less than all the features of a single disclosed embodiment. Thus, the following claims are hereby incorporated into the Detailed Description, with each claim standing on its own as a separate embodiment of the invention.

We claim:

1. A towable sweeping apparatus comprising:

a housing supported by a plurality of surface-engaging wheels;

an impeller mounted to the housing and adjustable relative to the surface, the impeller comprising a plurality of blades rotatable about an axis;

wherein a space permitting air flow is present between a portion closest to the axis of at least one of the plurality of blades and the axis;

a drive motor inter-operably connected to the impeller;

a bin arranged to receive debris collected by the impeller, the bin comprising an angulated surface adapted to facilitate removal of debris from the towable sweeping apparatus; and wherein a distance between the portion closest to the axis of at least one of the plurality of blades and the axis is adjustable.

2. The towable sweeping apparatus of claim 1, wherein the impeller is formed so as to permit air to flow transversely to a direction of travel of the towable sweeping apparatus along the plurality of blades.

3. The towable sweeping apparatus of claim 1, further comprising at least one door adjacent to the bin for removal of debris from the bin.

4. The towable sweeping apparatus of claim 1, wherein the impeller is adapted to rotate at a speed of 500–700 revolutions per minute.

5. The towable sweeping apparatus of claim 1, wherein the housing has formed therein at least one vent adjacent an end of the impeller.

6. The towable sweeping apparatus of claim 1, wherein the housing comprises at least one door for access to the impeller.

7. The towable sweeping apparatus of claim 1, further comprising an adjustable baffle located at an interface between the bin and the impeller.

8. The towable sweeping apparatus of claim 1, further comprising an adjustable baffle comprising a semi-cylindrical scraping member.

9. The towable sweeping apparatus of claim 1, wherein the housing comprises a curved front wall having a radius greater than a radius of the impeller.

10. The towable sweeping apparatus of claim 1, further comprising a grate structure covering a top of the bin.

11. A method of sweeping debris from a surface, the method comprising:

providing a sweeping apparatus comprising:

an impeller the impeller comprising a plurality of blades rotatable about an axis;

a plurality of surface-engaging wheels;

a motor inter-operably connected to the impeller;

wherein a space permitting air flow is present between the axis and a portion of at least one of the plurality of blades closest to the axis; and a bin arranged to receive debris collected by the impeller, the bin comprising an angulated surface adapted to facilitate removal of debris from the sweeping apparatus;

the motor driving the impeller at a rotational speed of not greater than 700 revolutions per minute in a direction opposite a rotational direction of the plurality of surface-engaging wheels;

depositing debris swept from the surface by the impeller into the bin;

the debris tending to move down the angulated surface toward an end of the sweeping apparatus opposite a direction of travel of the sweeping apparatus; and further comprising adjusting a distance between the plurality of blades and the axis.

12. The method of claim 11, further comprising adjusting a height of the impeller relative to the surface.

13. The method of claim 11, wherein the impeller is formed so as to permit air to flow transversely to the direction of travel along the plurality of blades.

14. The method of claim 11, further comprising adjusting a baffle located at an interface between the bin and the impeller.

15. The method of claim 14, wherein the baffle comprises a semi-cylindrical scraping member.

16. The method of claim 14, wherein the adjusting the baffle comprises positioning the baffle to within 1 inch of a radius of rotation of the impeller.

17. The method of claim 11, further comprising removing debris from the bin via at least one door located at an end of the sweeping apparatus opposite the impeller.

* * * * *